US011273461B2

(12) United States Patent
Schären et al.

(10) Patent No.: US 11,273,461 B2
(45) Date of Patent: Mar. 15, 2022

(54) DEVICE FOR INTERMITTENTLY APPLYING A FLOWABLE SUBSTANCE, AND METHOD FOR APPLYING SUCH A SUBSTANCE

(71) Applicant: Robatech AG, Muri (CH)

(72) Inventors: Micha Schären, Frick (CH); Claudio Hofer, Cham (CH); Hanspeter Felix, Zofingen (CH)

(73) Assignee: ROBATECH AG, Muri (CH)

( * ) Notice: Subject to any disclaimer, the term of this patent is extended or adjusted under 35 U.S.C. 154(b) by 312 days.

(21) Appl. No.: 16/355,823

(22) Filed: Mar. 17, 2019

(65) Prior Publication Data

US 2019/0299237 A1 Oct. 3, 2019

(30) Foreign Application Priority Data

Mar. 27, 2018 (EP) ..... 18164282

(51) Int. Cl.

| | |
|---|---|
| ***B05B 12/08*** | (2006.01) |
| ***B05D 5/10*** | (2006.01) |
| ***B05C 5/02*** | (2006.01) |
| ***B42C 9/00*** | (2006.01) |
| ***B05C 11/10*** | (2006.01) |
| *B05B 9/04* | (2006.01) |

(52) U.S. Cl.

CPC ..... *B05B 12/085* (2013.01); *B05C 5/0266* (2013.01); *B05C 11/1013* (2013.01); *B05C 11/1039* (2013.01); *B05D 5/10* (2013.01); *B42C 9/0006* (2013.01); *B05B 9/0403* (2013.01); *B05B 12/087* (2013.01); *B05C 5/0258* (2013.01); *B05C 11/1042* (2013.01)

(58) Field of Classification Search

None

See application file for complete search history.

(56) References Cited

U.S. PATENT DOCUMENTS

2003/0148018 A1* 8/2003 Hoffmann ..... B05B 12/126 427/8
2010/0310765 A1 12/2010 Olsson et al.
2014/0017038 A1 1/2014 Knoefel et al.
(Continued)

FOREIGN PATENT DOCUMENTS

DE 41 21 792 A1 1/1993
DE 42 11 942 A1 10/1993
(Continued)

*Primary Examiner* — Jethro M. Pence

(74) *Attorney, Agent, or Firm* — Christopher C. Dremann, P C.; Christopher C. Dremann

(57) ABSTRACT

A device for intermittently applying a flowable substance to a substrate includes an applicator nozzle for applying the flowable substance to the substrate, a tank for holding the flowable substance, a pump for delivering the substance, wherein the pump is actively connected to the tank, and further including an actuator actively connected to the pump and transferred into two positions, in a first position the actuator conducts the substance to the applicator nozzle, and in a second position the actuator blocks the feed to the applicator nozzle, and further including a control device for activating the actuator and for regulating the speed of the pump. A method for applying the substance using the device is also provided.

17 Claims, 5 Drawing Sheets

(56) References Cited

U.S. PATENT DOCUMENTS

| | | | | |
|---|---|---|---|---|
| 2014/0193277 | A1* | 7/2014 | Mrozek | F04B 53/08 417/53 |
| 2015/0165472 | A1* | 6/2015 | Komatsubara | B05C 11/1013 427/8 |
| 2015/0298162 | A1* | 10/2015 | Ikagawa | B05C 11/10 427/421.1 |

FOREIGN PATENT DOCUMENTS

| | | | |
|---|---|---|---|
| EP | 1 691 076 | A1 | 8/2006 |
| EP | 2 319 707 | A1 | 5/2011 |

* cited by examiner

DEVICE FOR INTERMITTENTLY APPLYING A FLOWABLE SUBSTANCE, AND METHOD FOR APPLYING SUCH A SUBSTANCE

FIELD OF THE INVENTION

The invention relates to a device for intermittently applying a flowable substance, in particular a flowable adhesive, to at least one substrate, having an applicator nozzle for applying the flowable substance to the substrate, a tank for holding the flowable substance, a pump for delivering the flowable substance, and a drive means, wherein the pump is actively connected to the tank and the pump can be driven by means of the speed-regulatable drive means, and moreover having an actuator which is actively connected to the pump and can be transferred into two positions, wherein in a first position the actuator conducts the flowable substance to the applicator nozzle, and in a second position blocks the feed to the applicator nozzle, and furthermore having a control device for activating the actuator and for regulating the speed of the drive means of the pump.

The invention moreover relates to a method for applying a flowable substance to a substrate using such a device.

BACKGROUND AND RELATED ART

Devices of the aforementioned type are used in different ways. The main field of application is considered to be the applying of flowable adhesives by means of the devices. A further essential field of application is, in contrast to adhesive technology, coating technology and hence the applying of flowable substances for the purpose of coating substrates by means of the device.

In the production of adhesive-bound printed matter such as catalogs, magazines, brochures, paperback books, or similar products, printed sheets are gathered together to form loose book blocks and are then processed in an adhesive binder essentially on their spines, and then adhesive is applied to the book block spines and/or to the inside of the spine of a cover which is joined to the book block and then pressed against the latter. The book blocks are here each clamped in a transport clamp, circulating in a guided fashion, of the adhesive binder with the spines projecting downward.

When producing books using an adhesive binding method, it is known to apply the adhesive by means of applicator nozzles. The adhesive here is in particular a dispersion adhesive, a hot melt adhesive, or a combination of dispersion and hot melt adhesives. In recent years, a polyurethane adhesive, abbreviated to PUR, has hereby proved to be a hot melt adhesive which has a particularly high resistance to the sheets being pulled out and provides particularly advantageous results for the book block in terms of lay-flat behavior. This adhesive can also advantageously be used for poorer-quality paper, for example for coated papers in which the proportion of coating elements is greater than the proportion of fibers required for strength, and which are also harder to roughen in order to expose the fibers for applying the adhesive.

So-called slotted nozzle applicator devices are preferably used for processing reactive adhesives, for example polyurethanes which chemically react with moisture in the environment. The adhesive is usually liquefied in a sealed pre-melter filled with a dry gas and fed to an applicator head of the applicator nozzle in the form of a slotted nozzle, via an adhesive feed line, by means of a positive-displacement pump and transferred by said applicator head to the book block spine or the cover. The amount of adhesive that needs to be conveyed per unit time depends on the speed at which the book block is conveyed, the thickness of the book block, and the thickness to be obtained of the adhesive film to be applied to the book block spine or the cover. Based on these parameters, a control device calculates the required speed of the pump or the amount of adhesive to be delivered by the pump. The feed of adhesive to the slotted nozzle needs to be interrupted in the region between successive book blocks.

A device which works in accordance with the above description and has the features of a device according to the invention is known from EP 2 319 707 A1. This device has, between a control valve and an applicator nozzle, an adhesive retraction device, connected to the control device, which is connected to the control device via a valve. In order to apply the adhesive film, the control valve is opened, the pump started and accelerated to the calculated speed, and the adhesive stored in the adhesive retraction device is ejected through the latter, essentially simultaneously. A clean, defined start of an adhesive film can be achieved by the common and chronologically coordinated action of the pump, the control valve, and the adhesive retraction device. During the application of adhesive, a drive means of the delivery pump turns at a constant speed. In order to finish the application of adhesive, the control valve is closed, the pump is stopped, and adhesive which can be made available again for ejection for the next adhesive film is received by the adhesive retraction device, essentially simultaneously. This device has a complex structural design and its control requires a high degree of complexity. These disadvantages are caused in particular by the fact that the adhesive retraction device needs to be provided for the device and in addition needs to be activated, in particular coordinated with the activation of the actuator or valve which is actively connected to the pump and can be transferred into the two positions, namely into the first position in which the flowable adhesive is conveyed to the applicator nozzle, and into the second position in which the supply to the applicator nozzle is blocked.

An adhesive valve for intermittently applying adhesive strips to material in the form of webs, for example paper webs, is known from DE 42 11 942 A1. This adhesive valve is a switching valve for applying adhesive. The valve has a valve housing with an adhesive feed line which is connected to a pump for delivering the adhesive to the valve, and moreover the valve housing has an adhesive return line which is connected to an adhesive storage tank. The adhesive is delivered to the adhesive outlet of the valve by means of the pump when the adhesive outlet is open. When the adhesive outlet is closed, the pump continues to run without any significant pressure fluctuations occurring. For this reason, when the adhesive outlet is closed, a connection is produced between the adhesive feed line, on which the pump acts, and the adhesive return line.

A nozzle application system is described in DE 41 21 792 A1 for applying hot melt adhesive to book block spines by means of a slotted nozzle. A pump which takes the form of a geared pump is integrated into an applicator head. The pump delivers a constant volume flow of adhesive. After a valve for feeding adhesive to the slotted nozzle is closed, the fed adhesive is circulated via a pressure relief valve, which can be set, and fed back to the pump. The valve is a self-setting pressure relief valve in the line, which flushes away the amount of adhesive which continues to be fed through during the pause between applications and the counter-force of which can be regulated by control means via the control system in such a way that the flushing pressure exceeds the required application pressure. The application pressure is hereby measured in advance and supplied to the control system for storage. The application pressure is measured for each working cycle and stored for the next interruption in the application.

In the case of a quantity regulation with a circulation system, the required adhesive volume flow is determined depending on the application thickness of an adhesive, the book block thickness, and the speed at which the book blocks move. The required speed of the adhesive pump is set and regulated on the basis of the required adhesive volume flow and a known delivered quantity per rotation of an adhesive pump. An encoder is provided to record the processing speed. The adhesive circulates continuously in a circulatory adhesive system. An applicator head has a valve which is designed as a switching valve. The purpose of the switching valve is to alternately convey the adhesive from a pressure source to an applicator nozzle or into a return hose. If the valve is in the applicator nozzle position, the adhesive flows to the applicator nozzle. If the valve is in the return hose position, the adhesive flows back into the tank of a pre-melter. A choke, which can be adjusted steplessly by a motor, is installed in the return hose upstream from the tank of the pre-melter. The purpose of the choke is to generate approximately the same pressure drop in the return line as via the applicator nozzle such that the adhesive pressure generated by the adhesive pump changes only negligibly when the switching valve is actuated and switches the return line back and forth via the choke between adhesive applications via the applicator nozzle. It is thereby ensured that the pressure ratios do not change at the start of the adhesive application and the application forms a precise beginning on the book blocks. At the start of the application, only the adhesive in the applicator nozzle needs to be accelerated. The volume in the adhesive hoses and the elasticity of the hoses have no influence on the adhesive application. Volume regulation for the adhesive pump can essentially be used. It has been shown in practice that quantity regulation with a circulation system is not simple to regulate for a precise adhesive application. It has been shown to be very important to set the flow resistance of the choke accurately. In order to be able to determine the setting of the choke, a separate calibration procedure for determining the choke position is required for each setting of the length of the outlet cross-section of the applicator nozzle, for each type of adhesive, and for each production rate. The data from the calibration are stored in a data matrix and can be reused for similar adhesive configurations. This system produces very good adhesive applications. Disadvantages are the high cost of the application system, in particular for the choke which can normally be set via a servomotor, and the high degree of complexity for the calibration procedures.

An application device is known from EP 1 691 076 A1 in which a positive-displacement pump is used, wherein application material can be recycled via a return line from an output opening of the pump to an input opening of the pump. A return valve, which is designed to free and to block, preferably also to restrict, the flow of material through the return line, is hereby associated with the return line. The return valve is a valve with a variable throughflow cross-section which changes its throughflow cross-section depending on the pressure of the application material at the input side, in particular enlarges its throughflow cross-section when the pressure rises and reduces it when the pressure falls.

OBJECTS AND SUMMARY OF THE INVENTION

An object of the present invention is to further develop a device of the aforementioned type such that a precise intermittent discharge of flowable substance from the applicator nozzle is ensured with a low degree of structural complexity and control complexity. Another object of the invention is to provide an advantageous method using such a device.

These and other objects are achieved by a device according to the invention, and moreover by a method according to the invention.

In the device according to the invention, the arrangement of the drive means and the pump has a characteristic according to which the speed of the drive means is linearly linked with the displacement volume of the pump. The device is configured such that, in a second position, with the pump being driven, the actuator feeds the flowable substance back to the tank via a line. The speed of the drive means is different in the two positions of the actuator, i.e. in the first and the second position.

The device thus has a feed line to the switchable actuator, and a return line from the switchable actuator to the tank. The flowable substance can thus circulate from the tank to the actuator via the pump and, when the actuator is situated in the second position, from there back to the tank. In the first position of the actuator, the flowable substance is conveyed to the applicator nozzle and the return line to the tank is blocked so that there is no circulation in this case. Because the speed of the drive means is linear with respect to the displacement volume of the pump, the speed of the drive is a direct indicator of the displacement volume. A different displacement volume in the respective position of the actuator is delivered by selecting the speed of the drive means to be different in the two positions of the actuator. Defined speeds in the two different positions of the actuator hence make it possible to create pressure ratios in the device by the pressure of the flowable substance which prevails directly at the actuator being essentially the same irrespective of whether the actuator is situated in one or the other position and hence irrespective of whether the flowable substance is discharged through the applicator nozzle or alternatively, when the actuator is situated in the second position, the flowable substance does not pass to the applicator nozzle and instead is fed back to the tank via the line. Because there are no relevant different pressures prevailing at the actuator, irrespective of the position in which the actuator is situated, no process-relevant changes in pressure are to be noted in the region of the actuator when the actuator is transferred from the second position into the first position, i.e. into the position in which the flowable substance is conveyed to the applicator nozzle. A simple and cost-effective device can thus be presented. The influence of the feed line for the flowable substance and the return line for the flowable substance on the metering of the flowable substance and the uniformity of the application of flowable substance is consequently minimized. The pressure of the flowable substance upstream from the actuator is essentially constant during the application of the flowable substance and during the period between two applications of the flowable substance.

The speed of the drive means is preferably proportional to the displacement volume of the pump.

It is considered to be particularly advantageous if the speeds of the drive means in the two positions of the actuator are such that the pressure of the flowable substance upstream from the actuator during the discharging from the applicator nozzle and during the returning of the flowable substance to the tank is essentially the same. "Essentially" is hereby understood to mean that the pressure of the flowable substance during the discharging should be no more than 10 percent more or less than the pressure during the return of the flowable substance to the tank, and preferably no more than 5 percent.

According to an embodiment of the invention, it is provided that the actuator has a switching valve which can be switched into the two positions. The function of switching into the two positions is thus effected by means of a single switching valve.

According to another embodiment, it is provided that the actuator has two valves, wherein, in a first position, a first valve conveys the flowable substance to the applicator nozzle and, in a second position, blocks its feed to the applicator nozzle, and, in a first position, the second valve blocks the flow back to the tank and, in a second position, frees the flow back to the tank. Two independent valves are thus provided in this design.

According to another embodiment of the invention, it is provided that an outlet cross-section of the applicator nozzle, in particular an applicator nozzle in the form of a slotted nozzle, can be modified, in particular its length can be modified whilst the width of the outlet cross-section remains constant. The use of a slotted nozzle is in particular provided when adhesive-bound printed products are to be produced by means of the device and the adhesive needs to be applied on printed products which are conveyed intermittently, in the region of book block spines and/or the insides of the spines of covers. If printed products of different thicknesses need to be produced, the length of the slotted nozzle must be adapted in accordance with this thickness. Given that the printed products are conveyed in a straight-line movement, the length of the slotted nozzle cross-section corresponds to the width of the adhesive application on the respective printed product, and the length of the application is a result of the amount of time for which the slotted nozzle is open whilst the printed product is conveyed along the slotted nozzle.

A choke is preferably integrated into a return-flow section of the actuator or into the line through which the flowable substance is conveyed to the tank. This choke is in principle not necessary. The advantage of a choke is that a flow through the choke can be presented which, with respect to the characteristics of applicator nozzle, can be adjusted in particular with the modifiable characteristics of the slotted nozzle. As a result, only slightly different ratios result for the device for the two switched positions of the actuator.

The choke is usually a separate component. It is, however, absolutely conceivable for the choke to be formed by a line section which effects a throttling action owing to its length. The choke can, on the other hand, also be the actuator itself which, by virtue of its design, effects the throttling action in the second position of the actuator, i.e. when the flowable substance is fed back.

It may or may not be possible to set the choke. It is in particular not possible to set the choke. It is preferably provided that the flow resistance of the choke, in particular a rigidly installed choke, corresponds approximately to the flow resistance of the applicator nozzle in the case of an average setting of the length of the outlet cross-section of the applicator nozzle, i.e. in the case of an average setting of the application width of the flowable substance, in particular the flowable adhesive, on the respective printed product, and to an average production speed of the book block. By means of a change in the speed of the drive means of the pump and hence the linear change in the delivered volume flow, an approximately identical drop in pressure is generated in the return line and via the fixed choke as via the applicator nozzle such that the pressure of the flowable substance generated by the pump changes only negligibly when the actuator is activated. The speed of the drive means of the pump is thus also modified at the same time as the switching of the actuator. It is consequently ensured that the pressure ratios do not change and the application has a precise beginning at the start of the application. The volume in the hoses for the flowable substance and the elasticity of the hoses have no effect on the application behavior. Volume regulation for the pumps can essentially be used.

According to another embodiment of the invention, it is provided that a pressure sensor for determining the pressure of the flowable substance is arranged upstream from the actuator, in particular adjacent to the passage of the flowable substance through the actuator to the applicator nozzle, wherein the pressure of the flowable substance can be determined by means of the pressure sensor and can be transmitted to the control device. A pressure sensor of this type makes it possible to calibrate the device. The pressure sensor can hereby be installed only temporarily for adjustment purposes and/or for calibration purposes. On the other hand, the pressure sensor can be a permanent component of the device. However, the device is then more complex in structure and more expensive.

In the case of the device, a device for limiting the pressure of the flowable substance can be present downstream from the pump. A maximum pressure, in particular a maximum pressure which can be set, is preferably monitored by the pressure sensor. Control means are provided which switch off the pump when the maximum pressure is exceeded and switch the actuator into its return position. As a result, overloading of the device which would result in damage to it can be effectively excluded.

According to a method for applying a flowable substance to a substrate using the described device or taking into account the described development of the device, it is provided that the ratio between the volume flow of the flowable substance during the application of the flowable substance and the volume flow of the flowable substance during the return flow to the tank is determined by an adjustment procedure.

It is considered to be particularly advantageous if the described ratio is determined by an adjustment process. The adjustment process is in particular dependent only on the set length of the outlet cross-section of the applicator nozzle. Chosen in particular for the adjustment process are the speed of a substrate being conveyed relative to the applicator nozzle and/or the thickness of the flowable substance to be applied to the substrate and/or the viscosity of the flowable substance and/or the flow behavior of the flowable substance in an average range of use. The adjustment can hereby take place with a relatively low degree of complexity and hence relatively simply.

Alternatively, it is considered to be preferable if the adjustment process takes place with software control and automatically. In particular, the whole adjustment range of the applicator nozzle is first covered and, when the lengths of the outlet cross-section of the applicator nozzle are chosen, a pressure prevailing at the pressure sensor and the speed of the drive means are determined. The actuator is then switched to circulation mode and the respective speeds of the drive means are determined at which in each case the pressure at the pressure sensor is the same as during the application of the substance by means of the applicator nozzle, for the same selected lengths with the same selected conditions. The multiple determined ratios between the volume flow during the application of the flowable substance and the circulation are stored and used by the control device during the subsequent operation of the device.

According to an alternative embodiment, during the adjustment process, when operating with a constant conveying speed of the substrate, the percentage deviation in pressure between the start and the end of the application of the flowable substance to the substrate is measured and averaged over a plurality of application cycles, and the speed ratio of the pump between the application of the flowable substance and the circulation of the flowable substance changes automatically in increments until the measured deviation in pressure during the application of the flowable substance is minimal.

An advantage of the device described herein and the method described herein consists in the fact that there is no build-up of a dynamic pressure at the beginning of the application of the flowable substance, in particular at the beginning of the application of adhesive. As a consequence of the circulation system, there is almost no accumulation of the flowable substance in the feed line and the return line as the flowable substance does not remain there as long as the substance is held in a flowable state. The length of the outlet cross-section of the applicator nozzle, and hence the application width of the flowable substance on the substrate or these substrates, can be adjusted during that period of time which remains during the production between two successive applications of flowable substance. After the adjustment, there is usually no need to retract the applicator nozzle so that the quality of the application on the first substrate, in particular on the first book, after the adjustment is already sufficient. As a result, the device is best suited for digitally produced products, in particular digitally produced printed products, which are produced in very short print runs. An adjustment process can be performed quickly and simply. Under specific conditions, the user does not have to carry out any adjustment process at all.

The positive displacement of the flowable substance described in connection with the present invention is used when the operating conditions of the device are constant, and hence in particular when the thickness is uniform, the temperature of the flowable substance is constant, and the viscosity of the flowable substance is constant. Two transmission ratios are usually chosen for the drive means. One transmission is chosen for the application of the flowable substance. The other transmission is chosen for the circulation of the flowable substance. In the case of unstable operating conditions, for example at the start of the application, of a change in the application width, or of a change in the speed of the substrates, it can be advantageous to use pressure regulation temporarily instead of the positive displacement. An unstable procedure can be compensated for very quickly by pressure regulation. Once the desired operating conditions, in particular the desired pressure upstream from the nozzle, have been achieved, the device can be switched back to the positive displacement of the pump. Temporary pressure regulation reduces the duration of unstable procedures and operating states such that the quality of the applied substance deviates as little as possible and for as short a period of time from the target value.

Other advantages and features of the invention will be apparent from the following detailed description, the description of the drawings, and the drawings themselves, wherein the individual features and combinations of the individual features are described and shown.

BRIEF DESCRIPTION OF THE DRAWING FIGURES

The invention is illustrated in schematic views in the drawings with reference to exemplary embodiments without being limited thereto.

DETAILED DESCRIPTION OF EXEMPLARY EMBODIMENTS

Figure 1:
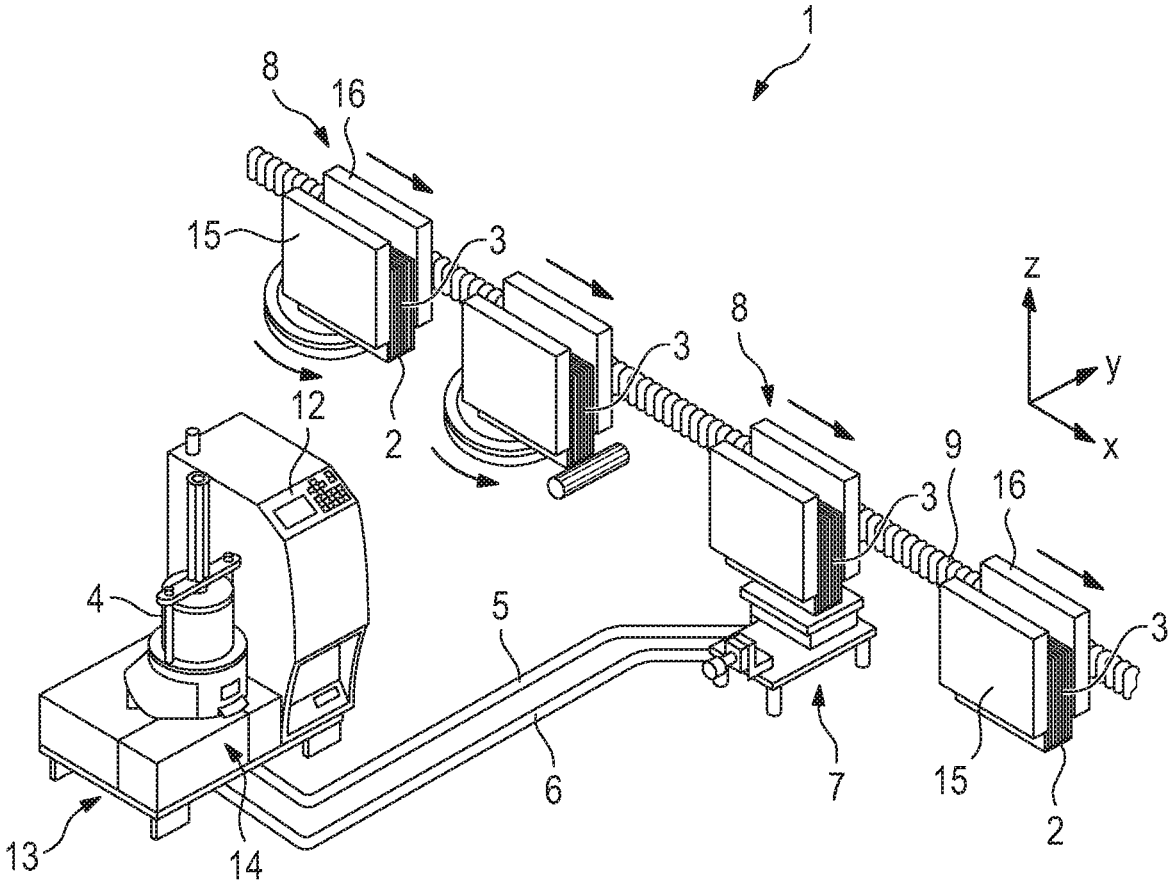
FIG. 1 shows a device for intermittently applying a flowable substance, which is adhesive, to a substrate, which is a book spine.

FIG. 1 illustrates the installed situation of a device 1 for intermittently applying a flowable adhesive to substrates, in the present case to book spines 2 of book blocks 3. The adhesive is, for example, polyurethane. This hot melt adhesive has a particularly high resistance to the sheets being pulled out, and moreover an optimum lay-flat behavior for book blocks 3.

Figure 2:
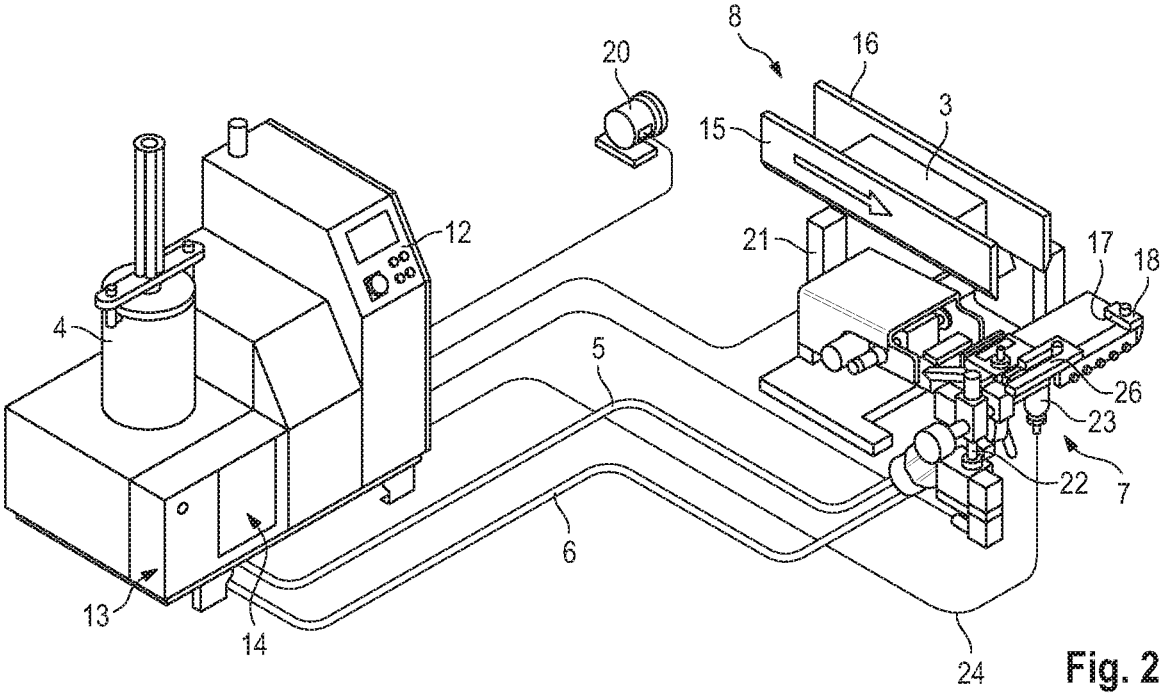
FIG. 2 shows the device of FIG. 1 in a detailed view of the part regions.

With reference to the view in FIGS. 1 and 2, with respect to the device 1, a pre-melter 4, a feed line 5 for the heated adhesive, a return line 6 for the heated adhesive, and an application station 7 for the heated adhesive are shown. The book blocks 3 are clamped in transport clamps 8 and are moved by a pulling means 9 in a direction of movement which corresponds to the illustrated coordinates X of a coordinate system, over the application station 7, and to be precise an applicator nozzle 10 of the application station 7. The other coordinates Y and Z are illustrated. A rectangular outlet cross-section 11 of the applicator nozzle 10, viewed in the plan view, in an opposite direction to the coordinate Z, has an adjustable longitudinal extent in the direction Y, and a constant widthwise extent in the direction X. The variable longitudinal extent of the outlet cross-section is matched to the respective width of the book block 3, wherein this width extends in the direction Y, and the applied length of the adhesive on the book spine 2 of the book block 3 results from the conveying movement of the respective book block 3 in the direction X when the applicator nozzle 10 is open. Depending on the conveying speed of the book spine 2 relative to the open applicator nozzle 10 and on the mass flow rate of the adhesive through the outlet cross-section 11 of the applicator nozzle 10, a defined application thickness in the direction Z results on the book spines 2 (see in particular the view in FIG. 4).

The adhesive is applied uniformly to the book spines 2 with the aid of a control device 12, an electric drive means 13, and a pump 14, which can be driven by means of the drive means 13, for conveying the flowable adhesive. The speed of the drive means 13 can be regulated. The pump 14 is a geared pump.

The respective transport clamp 8 has a front jaw 15 in the form of a plate and a rear jaw 16 also in the form of a plate.

The jaws 15, 16 of the respective transport clamp 8 are moved synchronously in the direction X. The respective rear jaw 16 cannot move in the direction Y. Only the front jaw 15 can move in the direction Y and in the opposite direction such that the distance between the two jaws 15, 16 can be modified in order to clamp the book blocks 3 between the jaws 15, 16. The respective rear jaw 16 forms, on the side facing the front jaw 15, a plane spanned by the coordinates X and Z which essentially lies on the same plane, apart from slight deviations, as a bearing surface 17 of a fixed feed guide 18 of the application station 7. This feed guide 18 forms a guide for the book blocks 3 on an applicator head 19 of the application station 7.

Actively connected to the control device 12 are a sensor 20 for detecting the transport speed of the book block 3 in the direction X, a sensor 21 for detecting the beginning and end of the respective book block 3, relative to the direction X, and an actuator 22, in the form of a valve, for feeding the flowable adhesive to the applicator head 19 and, if required, a pressure sensor 23 via a connection line 24. The flowable adhesive is fed from the pre-melter 4 via the feed line 5 by positive displacement from the pump 14, which is driven by means of the drive means 13, and controlled via the control device 12. Adhesive conveyed by the pump 14 is returned to the pre-melter 4 via the return line 6 during periods when no adhesive is being applied.

Figure 3:
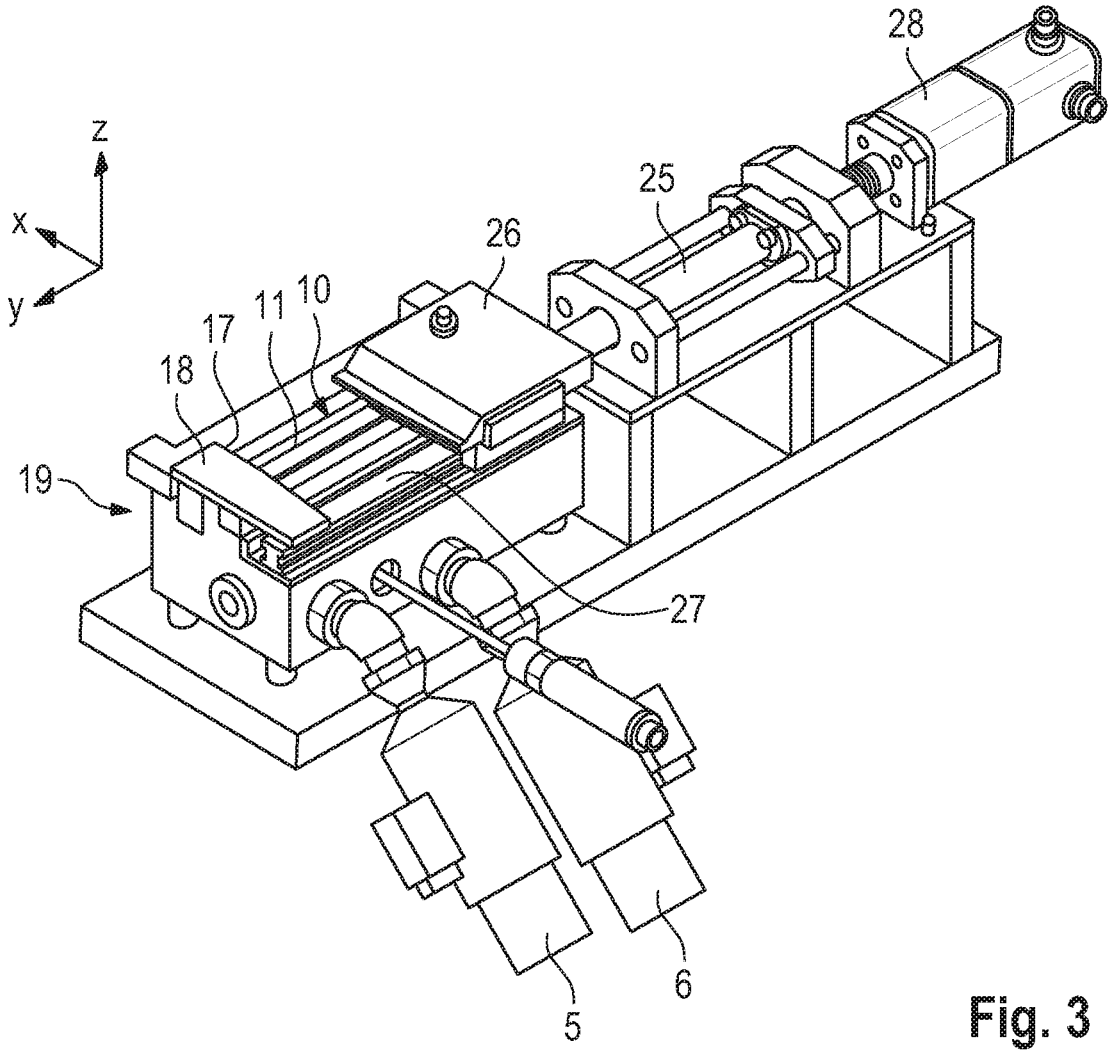
FIG. 3 shows the device of FIG. 1 in a part region in which is arranged the applicator nozzle with a length which can be adjusted in terms of its outlet cross-section.

FIG. 3 illustrates details of the applicator head 19 with an adjusting mechanism 25 for adjusting the outlet cross-section 11 of the applicator nozzle 10 by a cover, which covers the outlet cross-section 11 to a greater or lesser degree, being displaceable in the direction Y and in the opposite direction by means of the adjusting mechanism 25. The respective book block 3 is moved linearly in the direction X over the applicator nozzle 10 in the form of a slotted nozzle. The flowable adhesive is thus transferred onto the book spine 2 via the outlet cross-section 11. The movable cover 26 is guided, with as little play as possible, by a linear guide 27 and is activated via the adjusting mechanism 25, which is driven by a drive means 28 of the cover 26, and is in each case adjusted such that the length Y of the outlet cross-section 11 corresponds essentially to the book block thickness.

Figure 4:
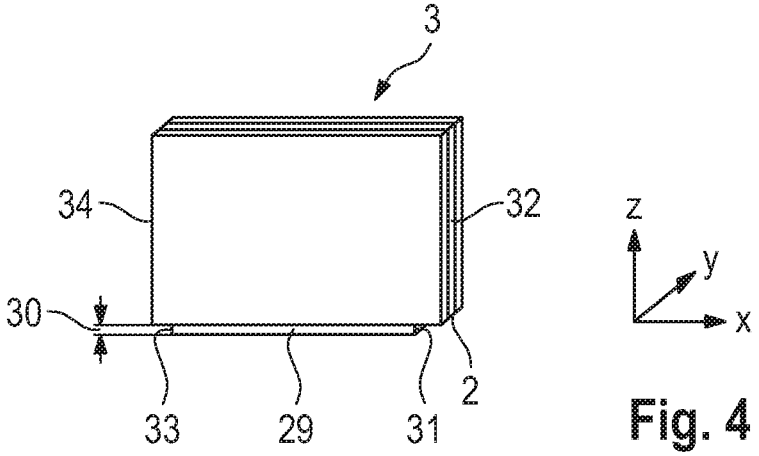
FIG. 4 shows a book spine with applied adhesive.

FIG. 4 shows a schematic diagram of a book block 3 and its most important dimensions, and moreover an application of adhesive 29. The adhesive is applied to the book spine 2. The application thickness 30 of adhesive can be set within a range of 0.05 to 4 mm. The application thickness preferably lies within the range of 0.3 to 0.6 mm for PUR. The distance from the beginning of the application 31 to the front side 32 of the book block 3 and the distance from the end of the application 33 to the rear side 34 of the book block 3 can be set to be between −5 and 100 mm. These values preferably lie between 0 and 15 mm. The application width, i.e. the dimension in the direction Y, corresponds essentially to the book block thickness and lies within the range of 1 to 80 mm. The maximum production rate of the book block 3 to be expected can be set to be between 1000 per hour and approximately 6000 per hour. The system described can, however, also be used for significantly higher production rates. The change in the application width is then restricted by adjusting the cover 26 between two successive book blocks.

The drive means 13 and the pump 14 are arranged underneath the pre-melter 4. The drive means 13 is connected to the pump 14 via a clutch.

Figure 5:
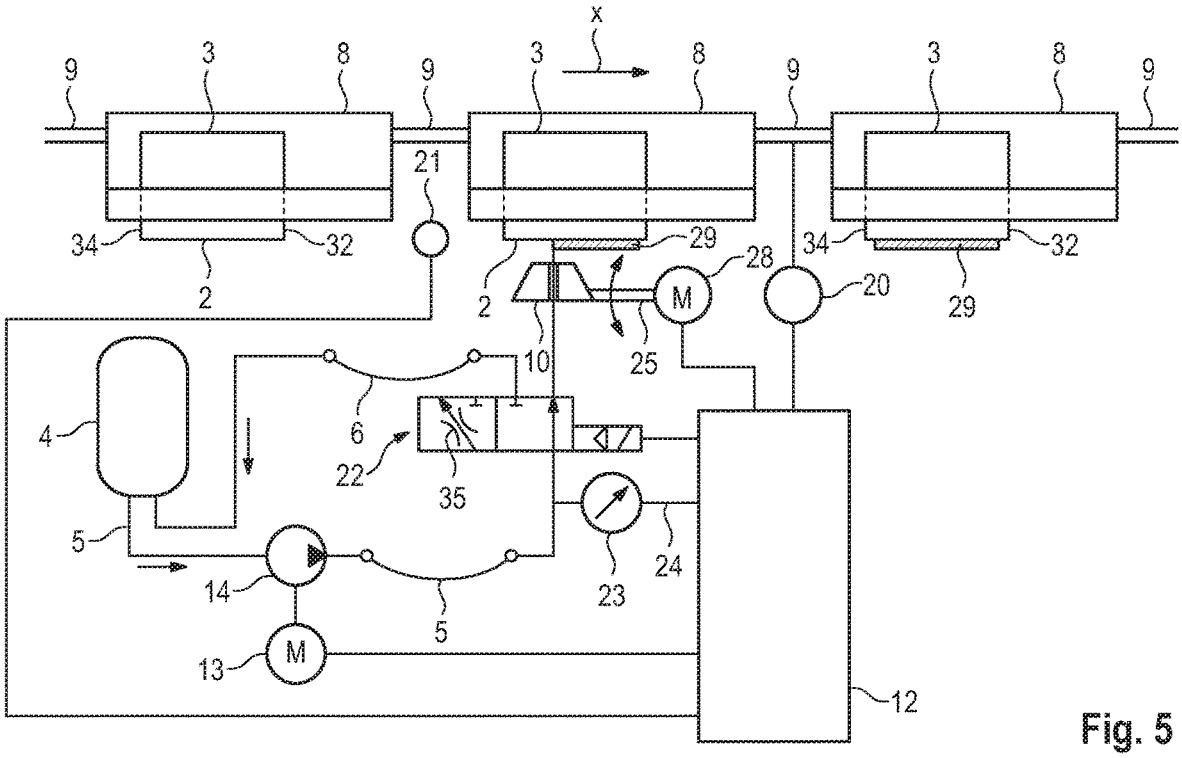
FIG. 5 shows an adhesive flow diagram for a first exemplary embodiment.

FIG. 5 shows the basic design of the device 1 connected to an adhesive binder. The transport clamps 8 of the adhesive binder are fastened to the pulling means 9 and are moved in the direction X at a defined speed. This speed generally remains constant during production. The book blocks 3 are clamped in the transport clamps 8 and moved together with the transport clamps 8. The speed of the book blocks 3 is detected by the sensor 20 and forwarded to the control device 12 for processing. The book front edge associated with the front side 32 and the book rear edge associated with the rear side 34 are detected by the sensor 21 and forwarded to the control device 12 for processing. The adhesive binder transmits the signals for the book block thickness in a suitable fashion to the control device 12 such that the latter can associate the book block thicknesses to be processed explicitly with the book blocks to be processed. The important thing here is that the control device 12 has the data for the speed and the book block thickness and can determine the time at which each application of adhesive starts and finishes. The manner in which the data required for this pass to the control device 12 can also take a different form to the one which has been shown or described.

The adhesive is melted in the pre-melter 4 in molten and held ready in flowable form. The pump 14 delivers the adhesive held ready in the pre-melter 4 via the feed line 5 and the actuator 22 or valve either to the applicator nozzle 10, during the application of adhesive to the book spines 2, or via the return line 6 back to the pre-melter 4. The pressure of the adhesive is detected by the optional pressure sensor 23 directly upstream from the actuator 22 and transmitted to the control device 12. The pressure sensor 23 is not strictly necessary for satisfactory functioning of the system and can be omitted for cost reasons or only installed temporarily.

The cover 26 of the applicator nozzle 10 for adjusting the application width of adhesive is activated, adjusted, and set via the adjusting mechanism 25 and the drive means 28. The signal and the triggering of the drive means 28 can either be provided or take place by the control device of the adhesive binder or by the control device 12 of the device 1. The actuator 22 for feeding the adhesive to the applicator nozzle 10 is activated by the control device 12 in such a way that the beginning of each adhesive application and the end of each adhesive application correspond precisely to the previously determined values. The actuator 22 takes the form of a switching valve. In a first position of the actuator 22, the flow from the feed line 5 to the applicator nozzle 10 is free and the return line 6 is blocked. In a second position of the actuator 22, the feed of the adhesive to the applicator nozzle 10 is interrupted and the feed line 5 is connected to the return line 6 via a choke 35 integrated into the actuator 22. Instead of this choke being integrated into actuator 22, this choke or a choke element can also be installed in the return line 6 as a separate component.

The drive means 13 of the pump 14 is triggered with the aid of all the above described signals by the control device 12 in such a way that the application of adhesive to the book blocks 3 has a well-defined start, a well-defined end, and a uniform distribution over the length of the application. This is effected by the adhesive being delivered by means of the pump 14 working essentially in a positive displacement fashion. The theoretical volume flow of adhesive during the application is determined from the speed of the book blocks 3 being moved, from the application width, and from the application thickness of the adhesive on the book block 3. The application thickness must be fed to the control device 12 as a parameter. This is generally effected via an input terminal which is operated by the user of the device 1. As part of digital book production, the predefined value for the application thickness can also be fed to the control device 12 by the adhesive binder or from a higher-level control system. It is likewise conceivable for the signal for the book block thickness to be fed to the control device 12 from a higher-level control system. Whilst the application of adhesive to the book blocks 3 is interrupted and the actuator 22 is switched to recycle adhesive to the pre-melter 4, the pump 14 generally delivers a volume flow of adhesive which differs from the volume flow of adhesive of the applied adhesive. This volume flow of adhesive during the recycling to the pre-melter 4, i.e. during the circulation of adhesive, is of a magnitude such that the pressure of adhesive upstream from the actuator 22 is as uniform as possible, as it is during the application of adhesive to the book spines 2 via the applicator nozzle 10.

The ratio between the volume flow of adhesive during the application of adhesive and the volume flow of adhesive during the circulation or the return of adhesive is primarily dependent on the set length of the outlet cross-section 11 of the applicator nozzle and hence on the application width of the adhesive on the respective book block 3. The flow resistance through the applicator nozzle 10 is dependent on the set length of the outlet cross-section 11 of the applicator nozzle 10. Secondly, the ratio between the volume of adhesive during the application of adhesive and the volume of adhesive during the circulation is dependent on the speed of the book blocks 3 and the application thickness 30, and on the viscosity and flow behavior of the adhesive used. The viscosity of the adhesive is furthermore dependent on the temperature of the adhesive and on the age or the ageing of the adhesive.

In order to determine the ratio between the volume flow of adhesive during the application of adhesive and the volume flow of adhesive during the circulation, the following options are proposed:

The ratio can be determined empirically without measuring pressures. The ratio is thus altered until the quality of applied adhesive reaches an optimum level. This procedure is repeated for a series of different parameters. All of the determined ratios for the volume flows are integrated into the control unit. In this way, it is conceivable that adhesive-application devices can be constructed and delivered without there being any need to carry out any adjustment or calibration procedures. If the present parameters differ from the parameters which exist during the empirical determination of the ratios of the volume flows, a somewhat reduced quality for the adhesive application needs to be taken into account.

A further option for determining the volume flow ratios can be to use a so-called default setting. An adjustment or calibration procedure is here performed for each individual adhesive-application device. The advantage of such a solution consists in the fact that the adjustment is tailored precisely to the components that are actually used, the hoses, the pre-melter, the applicator nozzle and also to the manufacturing and assembly tolerances of the actually used parts. The adhesive used later is then also used as much as possible for the temperature settings used later. It is conceivable to install the pressure sensor only for this default setting. The adjustment procedure can then run automatically with software control. Here, the whole adjustment range of the applicator nozzle is first covered and when the application widths for an average speed of the book blocks are chosen and an average application thickness of the adhesive, the adhesive pressure prevailing at the pressure sensor is determined. In a second step, the actuator is switched to circulation mode and, for the same selected application widths, those speeds of the pump or the drive means at which the adhesive pressure at the pressure sensor is in each case the same as during the adhesive application by means of the applicator nozzle. The ratios determined thereby between the adhesive volume flow during the adhesive application and the adhesive volume flow during circulation are stored and used by the control device during subsequent operation of the device.

A possible further alternative embodiment consists in the above described so-called default setting being performed again not only in the factory but also by customers before each time important operating parameters are changed, such as type of adhesive, speed setting, temperature setting, and modification of the application thickness. For this purpose, the pressure sensor is rigidly installed in the applicator head.

A further important alternative embodiment for the adjustment is represented by an automatic adjustment of the ratios between the adhesive volume flow during the application of adhesive and the adhesive volume flow during circulation. Values which have, for example, been determined via the default setting here serve as a basis or starting value. During ongoing operation, a check is carried out on an ongoing basis as to whether the prevailing adhesive pressure during the application of adhesive and the prevailing adhesive pressure during circulation are the same or lie within a tolerance which can be set. This tolerance is no more than ±10 percent, preferably no more than ±5 percent. If the difference in the two pressures is outside the set tolerance, the corresponding ratio of the adhesive volume flows is adapted in increments until the difference in the two pressures is within the predetermined tolerance.

In the adjustment process, it is also completely possible for the percentage deviation of the pressure between the start and end of the application of the flowable substance to the substrate and averaged over multiple application cycles during operation at a constant conveying speed of the substrate, and for the speed ratio of the pump to be modified automatically in increments between application of the flowable substance and circulation of the flowable substance until the measured pressure deviation during the application of the flowable substance is minimal.

Combinations of the above described methods can be used for determining the ratios of the adhesive volume flows for the application of adhesive and the adhesive volume flows for the circulation.

It is completely possible also for a maximum pressure, which can be set, to be monitored using the pressure sensor 23. When the maximum pressure is exceeded, the drive means 13 of the pump 14 switches off and the actuator moves into the return position.

Figure 6:
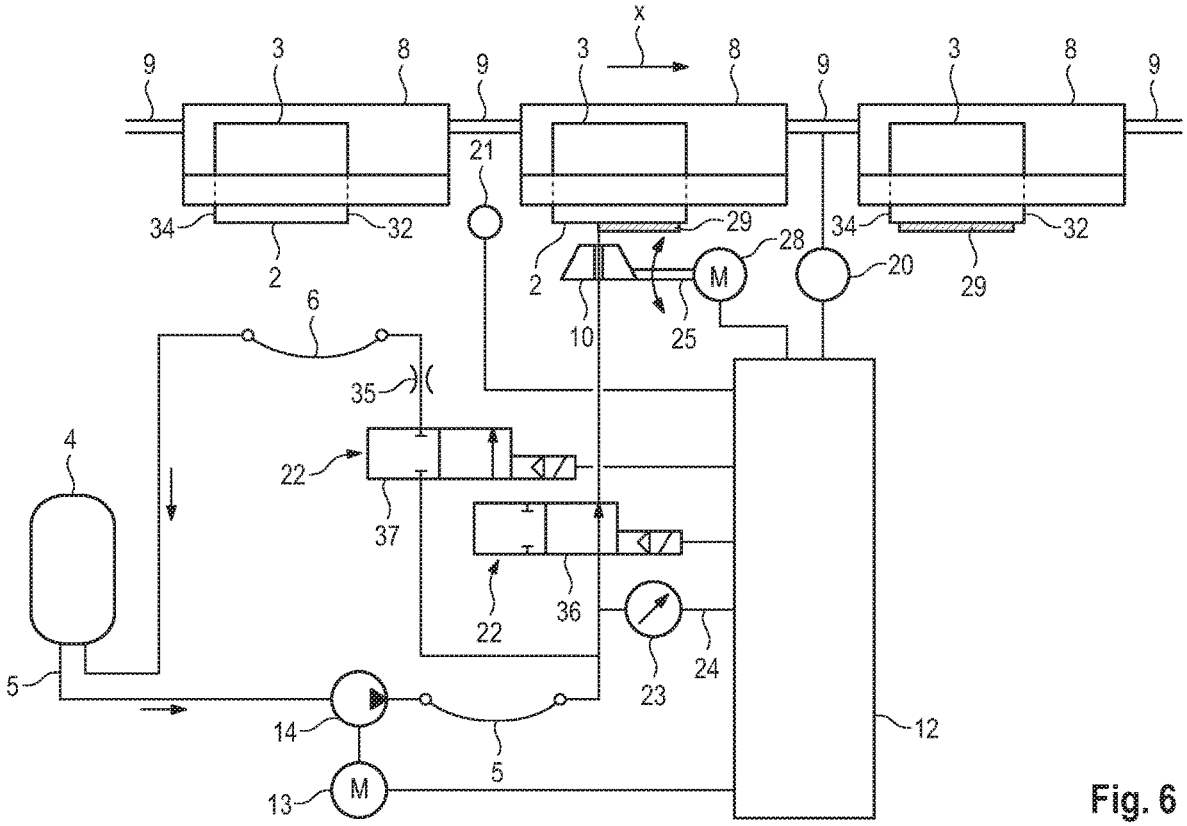
FIG. 6 shows an adhesive flow diagram for a slightly modified second exemplary embodiment.

FIG. 6 shows an arrangement which is slightly modified in comparison with the arrangement in FIG. 5. In contrast to the embodiment in FIG. 5 with the switching valve, the actuator 22 is designed such that it has two valves, a first valve 36 and a second valve 37. Two standard valves are used hereby. In a first position, the first valve 36 conveys the flowable substance to the applicator nozzle 10 and, in a second position, the first valve 36 blocks the feed to the applicator nozzle 10. In the first position, the second valve 37 blocks the return flow to the pre-melter 4 and, in the second position, the second valve 37 frees the return flow to the pre-melter 4. The choke element 35 is associated with the return line 6 immediately behind the second valve 37. The mechanical complexity and the technical complexity of the control system are greater for the alternative embodiment with the two valves 36, 37 than for the alternative embodiment with the switching valve.

That which is claimed is:

1. A device for intermittently applying a flowable substance to at least one substrate, comprising:

an applicator nozzle for applying the flowable substance to the substrate;

a tank for holding the flowable substance;

a pump for delivering the flowable substance from the tank; and a drive means of the pump;

wherein the pump is actively connected to the tank and the pump is driven by the drive means; and an actuator actively connected to the pump and operable to be transferred between two positions;

wherein in a first position the actuator conveys the flowable substance to the applicator nozzle, and in a second position the actuator blocks a feed of the flowable substance to the applicator nozzle; and a control device for activating the actuator and for regulating a speed of the drive means of the pump;

wherein the speed of the drive means is linear with respect to a displacement volume of the pump;

wherein with the pump being driven by the drive means, in the second position the actuator feeds a flow of the flowable substance back to the tank via a return line;

wherein in the first position the actuator blocks the flow of the flowable substance back to the tank; and wherein the speed of the drive means is different in the first position and the second position of the actuator.

2. The device as claimed in claim 1, wherein the speed of the drive means in the first position and the second position of the actuator is such that a pressure of the flowable substance upstream from the actuator during a discharging from the applicator nozzle and during a returning of the flowable substance to the tank is the same.

3. The device as claimed in claim 1, wherein the actuator is a switching valve which can be switched between the first position and the second position of the actuator.

4. The device as claimed in claim 1, wherein the actuator has a first valve and a second valve, and wherein, in the first position, the first valve conveys the flowable substance to the applicator nozzle and, in the second position, the first valve blocks the feed of the flowable substance to the applicator nozzle, and wherein, in the first position, the second valve blocks the flow of the flowable substance back to the tank and, in the second position, frees the flow of the flowable substance back to the tank.

5. The device as claimed in claim 1, wherein the applicator nozzle is in the form of a slotted nozzle and wherein a length of an outlet cross-section of the applicator nozzle can be modified when a width of the outlet cross-section of the applicator nozzle is constant.

6. The device as claimed in claim 1, wherein a choke is integrated into a return-flow section of the actuator or into the return line through which the flow of the flowable substance is returned back to the tank.

7. The device as claimed in claim 6, wherein it is not possible to set the choke.

8. The device as claimed in claim 6, wherein a flow resistance of the choke corresponds to a flow resistance of the applicator nozzle in an average setting of a length of an outlet cross-section of the applicator nozzle.

9. The device as claimed in claim 1, wherein a pressure sensor for determining a pressure of the flowable substance is arranged upstream from the actuator, and wherein the pressure of the flowable substance is determined by the pressure sensor and transmitted to the control device.

10. The device as claimed in claim 9, wherein the pressure sensor is installed only temporarily for adjustment purposes and/or for calibration purposes.

11. The device as claimed in claim 9, wherein a device for limiting the pressure of the flowable substance constituted by the pressure sensor, the control device and a connection line connecting the pressure sensor and the control device is present downstream from the pump and a maximum pressure is monitored by the pressure sensor, and wherein the control device switches off the drive means of the pump when the maximum pressure is exceeded and switches the actuator into a return position.

12. A method for applying a flowable substance to a substrate using a device as claimed in claim 1, wherein a ratio between a volume flow of the flowable substance during the application of the flowable substance and a volume flow of the flowable substance during a return flow to the tank is determined by an adjustment procedure.

13. The method as claimed in claim 12, wherein the adjustment process is dependent only on a set length of an outlet cross-section of the applicator nozzle at least one of a speed of the substrate being conveyed relative to the applicator nozzle and/or a thickness of the flowable substance to be applied to the substrate and/or a viscosity of the flowable substance and/or a flow behavior of the flowable substance in an average range of use are chosen for the adjustment process.

14. The method as claimed in claim 13, wherein the adjustment process takes place with software control and automatically such that the whole adjustment range of the applicator nozzle is first covered and, when the lengths of the outlet cross-section of the applicator nozzle are chosen, a pressure prevailing at a pressure sensor and the speed of the drive means are determined, and the actuator is then switched to circulation mode and the respective speeds of the drive means are determined at which in each case the pressure at the pressure sensor is the same as during the application of the substance by means of the applicator nozzle, for the same selected lengths with the same selected conditions, and wherein multiple determined ratios between a volume flow during the application of the flowable substance and the circulation are stored and used by the control device during the subsequent operation of the device.

15. The method as claimed in claim 12, wherein during the adjustment procedure, when operating with a constant conveying speed of the substrate, a percentage deviation in the pressure of the flowable substance upstream from the actuator between a start and an end of the application of the flowable substance to the substrate is measured and averaged over a plurality of application cycles, and a speed ratio of the pump between the application of the flowable substance and the circulation of the flowable substance changes automatically in increments until a measured deviation in pressure during the application of the flowable substance is minimal.

16. The method as claimed in claim 12, wherein the flowable substance is a flowable adhesive.

17. The device as claimed in claim 1, wherein the flowable substance is a flowable adhesive.

* * * * *